US006007190A

United States Patent [19]

Murray et al.

[11] Patent Number: 6,007,190

[45] **Date of Patent: *Dec. 28, 1999**

[54] INK SUPPLY SYSTEM FOR AN INK JET PRINTER HAVING LARGE VOLUME INK CONTAINERS

[75] Inventors: Richard A. Murray; William M. Fries; Mary E. Haviland, all of San Diego, Calif.

[73] Assignee: Encad, Inc., San Diego, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/365,833

[22] Filed: Dec. 29, 1994

[51] Int. Cl.[6] ..... B41J 2/175

[52] U.S. Cl. ..... 347/86; 347/85

[58] Field of Search ..... 347/85, 86, 43; 138/111, 112, 114–117; 141/330

[56] References Cited

U.S. PATENT DOCUMENTS

| | | | |
|---|---|---|---|
| 2,916,055 | 12/1959 | Brumbach | 138/111 |
| 3,461,337 | 8/1969 | Jung et al. . | |
| 3,708,798 | 1/1973 | Hildenbrand et al. . | |
| 3,967,286 | 6/1976 | Andersson et al. . | |
| 4,074,284 | 2/1978 | Dexter et al. . | |
| 4,126,868 | 11/1978 | Kirner | 347/86 |
| 4,178,595 | 12/1979 | Jinnai et al. . | |
| 4,183,131 | 1/1980 | Seya et al. . | |
| 4,187,511 | 2/1980 | Robinson . | |
| 4,342,042 | 7/1982 | Cruz-Uribe et al. . | |
| 4,383,263 | 5/1983 | Ozawa et al. . | |
| 4,394,669 | 7/1983 | Ozawa et al. . | |
| 4,399,446 | 8/1983 | McCann et al. . | |

(List continued on next page.)

FOREIGN PATENT DOCUMENTS

| | | | |
|---|---|---|---|
| 210879 | 12/1982 | Japan | 347/85 |
| 194854 | 11/1984 | Japan . | |
| 63-63455 | 4/1986 | Japan | 347/85 |
| 63455 | 4/1986 | Japan | 347/85 |
| 64751 | 3/1988 | Japan . | |
| 120655 | 5/1988 | Japan | 347/85 |
| 63-120655 | 5/1988 | Japan | 347/85 |
| 147651 | 6/1988 | Japan . | |
| 2-217257 | 8/1990 | Japan | 347/85 |
| 217257 | 8/1990 | Japan | 347/85 |
| 25465 | 1/1992 | Japan . | |
| 162326 | 6/1993 | Japan . | |

OTHER PUBLICATIONS

Erturk, et al., "Ink Retention In a Color Thermal Inkjet Pen", Hewlett–Packard Journal, pp. 41–44, Aug. 1988.

Specification Sheet for Hewlett–Packard Ink Jet Cartridge. Model No. 51639, 1992.

Specification Sheet for Hewlett–Packard Ink Jet Cartridge, Model No. 51626A.

*Primary Examiner*—N. Le
*Assistant Examiner*—Judy Nguyen
*Attorney, Agent, or Firm*—Knobbe, Martens, Olson & Bear, LLP

[57] ABSTRACT

An ink jet printer having an inking system that includes an ink jet cartridge, a large ink reservoir mounted on the ink jet printer at a location which is remote from the ink jet cartridge and tubing connecting the ink reservoir to the ink jet cartridge. The tubing and the ink reservoir are permanently mounted within the ink jet printer. Only the ink jet cartridge needs to be replaced, because the jet plate has a finite life span during which the print quality from the jet plate is satisfactory. The ink jet cartridge includes a quick release fitting which enables the easy disconnection of an old ink jet cartridge and reconnection of a new ink jet cartridge with the tubing. Further, the size of the ink jet cartridge is reduced since almost all of the ink storage is moved to a location which is remote from the ink jet cartridge. By removing a majority of the ink from the carriage assembly, the amount of weight attached to the carriage assembly is reduced and thus the amount of power required to move the carriage is reduced.

6 Claims, 5 Drawing Sheets

U.S. PATENT DOCUMENTS 4,403,233 9/1983 Terasawa et al. .
4,429,320 1/1984 Hattori et al. .
4,432,005 2/1984 Duffield et al. .
4,433,341 2/1984 Thomas .
4,437,104 3/1984 Hudson .
4,462,037 7/1984 Bangs et al. .
4,475,116 10/1984 Sicking et al. .
4,500,895 2/1985 Buck et al. .
4,509,062 4/1985 Low et al. .
4,513,297 4/1985 Okumura .
4,527,175 7/1985 Kujima et al. .
4,558,326 12/1985 Kimura et al. .
4,593,294 6/1986 Parisi .
4,610,202 9/1986 Ebinuma et al. .
4,611,656 9/1986 Kendall et al. ..... 138/112
4,623,905 11/1986 Ichihashi et al. .
4,631,556 12/1986 Watanabe et al. .
4,636,814 1/1987 Terasawa .
4,639,738 1/1987 Young et al. .
4,677,448 6/1987 Mizusawa et al. .
4,680,696 7/1987 Ebinuma et al. .
4,684,962 8/1987 Hirosawa et al. .
4,714,937 12/1987 Kaplinsky .
4,734,711 3/1988 Piatt et al. .
4,737,801 4/1988 Ichihashi et al. .
4,750,005 6/1988 Piatt et al. .
4,757,331 7/1988 Mizusawa .
4,775,871 10/1988 Abe et al. .
4,791,438 12/1988 Hanson et al. .
4,794,409 12/1988 Cowger et al. .
4,823,146 4/1989 Cooke et al. .
4,831,389 5/1989 Chan .
4,885,595 12/1989 Kaplinsky et al. .
4,921,811 5/1990 Watanabe et al. .
4,926,196 5/1990 Mizoguchi et al. .
4,929,963 5/1990 Balazar .
4,931,811 6/1990 Cowaer et al. ..... 347/87
4,931,812 6/1990 Dunn et al. .
4,959,667 9/1990 Kaplinsky .
4,967,207 10/1990 Ruder .
4,968,998 11/1990 Allen .
4,973,993 11/1990 Allen .
4,977,413 12/1990 Yamanaka et al.l .
4,992,802 2/1991 Dion et al. .
4,999,652 3/1991 Chan .
5,021,809 6/1991 Abe et al. .
5,025,270 6/1991 Undezawa ..... 347/85
5,040,001 8/1991 Dunn et al. .
5,051,759 9/1991 Karita et al. .
5,079,570 1/1992 Mohr et al. .
5,101,219 3/1992 Gerber et al. .
5,136,305 8/1992 Ims .
5,159,348 10/1992 Dietl et al. .
5,182,579 1/1993 Haruta et al. .
5,187,498 2/1993 Burger .
5,189,438 2/1993 Hine et al. .
5,221,936 6/1993 Saito et al. .
5,233,369 8/1993 Carlotta et al. .
5,245,360 9/1993 Ebimuma et al. .
5,245,365 9/1993 Woodward et al. .
5,280,300 1/1994 Fong et al. .
5,289,211 2/1994 Morandotti et al. .
5,311,214 5/1994 Hirasawa et al. .
5,367,328 11/1994 Erickson .
5,369,429 11/1994 Erickson ..... 347/85
5,454,409 10/1995 McAffer et al. ..... 141/330
5,469,201 11/1995 Erickson et al. ..... 347/85

52
54
50
46
58
41
56
59
26

41
42

26
41
62
48
38
44

26
46
54
39
59
42
38
48
52
50
64

26
41
48
38

26
7
38
48
7

INK SUPPLY SYSTEM FOR AN INK JET PRINTER HAVING LARGE VOLUME INK CONTAINERS

FIELD OF THE INVENTION

The present invention relates to ink jet printers. In particular, the invention relates to ink jet printers having a large-volume ink reservoir mounted at a location remote from the jet plate assembly.

BACKGROUND OF THE INVENTION

Ink jet printers and disposable ink jet cartridges for ink jet printers are well known in the art. Contemporary disposable ink jet cartridges typically include a self-contained ink reservoir, a jet plate assembly supporting plural ink jet nozzles in combination with the ink reservoir and a plurality of external electrical contacts for connecting the ink jet nozzles to driver circuitry. Typically, the entire cartridge must be disposed of when the ink in the reservoir is used up without regard to whether or not the jet plate assembly remains fully functional. The contemporary disposable cartridge therefore represents a considerable waste of product resulting in higher costs to the consumer both in product cost and the time involved in having to frequently replace the cartridge.

In point of fact, the jet plate assemblies used in the currently available disposable ink jet cartridges are fully operable to their original print quality specifications after the original ink reservoir has been depleted. As a result, it is known in the art to manually replenish the ink within the disposable ink jet cartridge during the time period when the print quality from the jet plate is known to be high, but the original ink in the ink jet cartridge has been depleted. Systems in which the disposable ink cartridge are refilled are, however, messy and difficult to implement because many disposable ink jet cartridges are not designed with refilling in mind. More recently, though, some ink jet cartridges have been designed to enable refilling, such as the ink jet cartridge disclosed by Hewlett-Packard in U.S. Pat. No. 5,280,300. These refillable ink jet cartridges are designed to enable refilling of the ink jet cartridge for a certain number of refills while the jet plate is still providing high quality printing capabilities. Making the cartridge easy to refill, however, does not mitigate the bother, time, and expense involved in having to refill this cartridge frequently.

Merely making the ink jet cartridge reservoir larger in size is not a satisfactory solution to problems associated with frequent replacement of or refilling of the ink jet cartridge. The ink jet cartridges are generally mounted on a print carriage of the ink jet printer. Therefore, the larger the volume of ink in the ink jet cartridge, the greater the amount of weight that is required to be moved by the printer carriage holding the ink jet cartridges. The additional weight of ink in the ink jet cartridges will cause significant demands on the motor that drives the printer carriage. In addition, ink jet cartridges are mounted on one side of the print carriage and cause an unbalanced load on the printer carriage which requires a counter balancing mechanism. Therefore, it is difficult to balance the need for providing a larger volume of ink to the ink jet cartridges to limit the number of times that the cartridges need to be refilled with the power consumption and loading problems that larger ink volumes cause for the printer carriage.

More recently, a system disclosed by Laser Master Corporation in U.S. Pat. Nos. 5,369,429 and 5,367,328 begins with a typical ink jet cartridge, having an ink reservoir and a jet plate assembly, mounted on a printer carriage and adds an external reservoir system which refills the ink reservoir in the ink jet cartridge as the printer is printing. The system disclosed in U.S. Pat. No. 5,369,429 is designed to replenish the ink reservoir which is integral to the ink jet cartridge with ink from the external supply while the cartridge is printing. The external ink reservoir, the ink jet cartridge, and the tubing connecting the external reservoir to the ink jet cartridge are configured to form a unitary single piece replaceable assembly. The volume of ink in the external reservoir is designed to be depleted when the print quality of the jet plate on the ink jet cartridge assembly has degraded to a level that may provide unsatisfactory printing results.

Systems, such as those disclosed by U.S. Pat. No. 5,369,429, require the disposal of a large ink reservoir, an ink jet cartridge, and the tubing connecting the two once the quality of the printing from the ink jet plate has degraded. The waste and initial cost to the consumer therefore still exists for this type of system. Moreover, as the concerns over disposal of large quantities of plastic goods increases, such bulky disposable systems are not desirable. In addition, the unitary plastic assembly becomes contaminated by the ink and may not be suitable for conventional disposal. Also, the replacement of the unitary one-piece unit of the LaserMaster system is difficult due to the size of the ink reservoir. Further, the tubing attached to the reservoir must be installed in the printer with care to ensure that it is properly positioned so as to not interfere with the moving parts of the printer.

The mechanism to which the tubing of the Laser Master System is mounted is an Igus chain which is a hollow plastic chain link that moves back and forth with the motion of the print carriage carrying the tubing behind it. As the Igus chain moves back and forth, it bends back upon itself, the radius of this bend is commonly referred to as the bend radius of the chain. The bend radius of the Igus chain is large, thus the envelope of the print housing must be increased to accommodate space for the large bend radius of the Igus chain as it bends back upon itself. Further, the Igus chain does not move smoothly and makes a clunking noise as the chain link moves back and forth which is not desirable. Finally, plastic chain links such as the Igus chains are also expensive.

SUMMARY OF THE INVENTION

The present invention is an ink jet printer which provides a continuous volume of ink to the jet plate assembly without suffering from the waste, cost and cumbersome disposal problems of the prior art systems. Advantageously, the inking system comprises a small removable ink jet cartridge providing a jet plate and an ink channel for directing the ink to the jet plate and a large ink reservoir permanently mounted on the ink jet printer at a location which is remote from the ink jet cartridge. Flexible tubing permanently mounted within the ink jet printer connects the reservoir to the ink channel of the cartridge to enable the print carriage to move back and forth while maintaining a connection from the ink reservoir to the ink jet cartridge. The permanently mounted ink reservoir can be refilled with ink from time to time for the entire lifetime of the ink jet printer without needing to be replaced.

A significant feature of the invention is that only the ink jet cartridge needs to be replaced, because the jet plate has a finite life span during which the print quality from the jet plate is satisfactory. The ink jet cartridge is removably mounted to the tubing via a quick disconnect fitting to enable easy replacement of the ink jet cartridge. Removal of the ink jet cartridge does not require the removal of other portions of the ink system in order to replace a worn out jet plate assembly. Therefore, the replacement of the jet plate assembly is easy for the user and does not require replacement of other tubing and ink reservoir means whose viable lifetime is much greater than that of the jet plate assembly. Thus, the ink supply system of the present invention substantially reduces waste, cost and disposal problems while providing a large volume of ink to the printer and maintaining high quality printing.

An important advantage of the ink system of the present invention is that substantially all of the ink is stored at a remote location from the ink jet carriage assembly, thereby reducing the amount of weight attached to the carriage assembly. The ink jet cartridge of the invention maintains only a minute, constant quantity of ink proximal to the jet plate, so that the load of the ink applied to the jet plate and the weight of the ink on the printer carriage does not vary as in other disposable ink systems. Advantageously, the print carriage does not need to be designed to operate under high-load, i.e., ink reservoir full, and low-load, i.e., ink reservoir low, situations as with disposable ink cartridges of the prior art. One example of a high-load condition would be four ink jet cartridges with their ink reservoirs full, such that each of the cartridges weigh 78 grams. One example of a low-load condition would be four ink jet cartridges with their ink reservoirs low such that each of the cartridges weighs 16 grams. Obviously, such a weight difference per cartridge multiplied by four cartridges, in this example, is a significant loading difference to take into consideration when designing the printer. By reducing the amount of ink stored in the ink jet cartridges and by maintaining the volume of ink in the ink jet cartridge at a constant level, the motor that powers the print carriage is designed for a constant load which is much smaller than the loading of the print carriages of the prior art. Further, since the ink jet cartridges are mounted on one side of the print carriage, the reduction in loading on one side of the carriage due to the reduction in ink weight in the cartridges reduces the amount of counterbalancing efforts for maintaining a balanced load.

A further advantage of the invention is that the ink reservoir is refillable using simple procedures and is located such that refilling of the ink reservoir is simple and does not interfere with other moving parts of the ink jet printer. In addition, the ink reservoir is refillable during the normal operation of the printer, i.e., printing does not have to be halted in order to refill the ink reservoir.

DETAILED DESCRIPTION OF THE PREFERRED EMBODIMENT

Encad, Inc., the assignee of the present application, manufactures and sells a multi-color ink jet printer under the trade name of Nova Jet III which currently utilizes four prior art disposable ink jet cartridges. An operations manual of the Nova Jet III printer entitled "Nova Jet III User's Guide" (Encad Part No. 202409) is hereby incorporated by reference.

Figure 1:
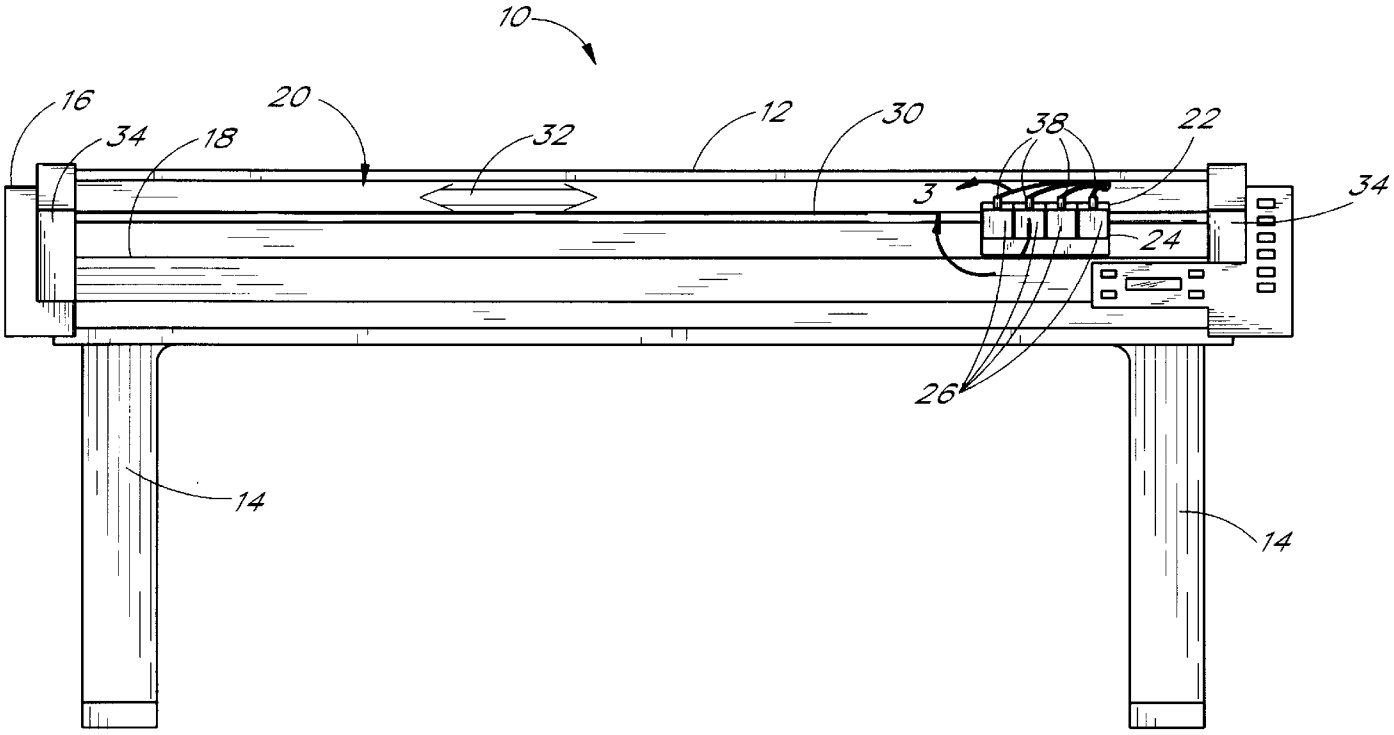
FIG. 1 is a front view of an ink jet printer comprising the ink supply system of the present invention.

The present invention is an improvement to the Nova Jet III by providing a large volume ink supply system for each of the ink jet plates. Referring to FIG. 1, an ink jet printer 10 incorporates the invention including a housing 12 which is supported by a pair of legs 14. The housing 12 encloses various electrical and mechanical components related to the operation of the printer device, but not directly pertinent to the present invention.

Either a roll of continuous print media (not shown) is mounted to a rear side 16 of the printer 10 to enable a continuous supply of paper to be provided to the printer 10 or individual sheets of paper (not shown) are fed into the printer 10. A portion of a top side of the housing 12 forms a platen 18 upon which the printing is performed by select deposition of ink droplets onto the paper. During operation, a continuous supply of paper is guided from the roll of paper mounted to the rear side 16 of the housing 12 and across the platen 18 by a plurality of dry rollers (not shown) which are spaced along the platen 18. In an alternate embodiment, sheets of paper or other print media are guided across the platen 18 by the rollers (not shown). A support structure 20 is connected to the top side of the housing 12 with sufficient clearance between the platen 18 and the support structure 20 along a central portion of the platen 18 to enable a sheet of paper or other print media which is to be printed on to pass between the platen 18 and the support structure 20.

The support structure 20 supports a print carriage 22 above the platen 18. The print carriage 22 includes a plurality of print head holders 24, each with a novel print head, also referred to as an ink jet cartridge, 26 mounted therein. In the preferred embodiment, four print heads 26 are mounted on the print carriage 22 each containing a different color of ink. Preferably, the four print heads contain black, magenta, cyan and yellow ink. The support structure 20 can be formed by a variety of structural components known to those of skill in the art. In a preferred embodiment, the support structure 20 generally comprises a guide rod 30 and a plurality of mounting seats 34 which support the guide rod 30 so that the guide rod 30 is positioned parallel to the platen 18. The print carriage 22 preferably comprises a split sleeve which slidably engages the guide rod 30 to enable motion of the print carriage along the guide rod 30 to define a linear printing path, as shown by the bidirectional arrow 32, along which the print carriage 22 moves. A motor and a drive belt mechanism (not shown) are used to drive the print carriage 22 along the guide rod 30.

Figure 10:
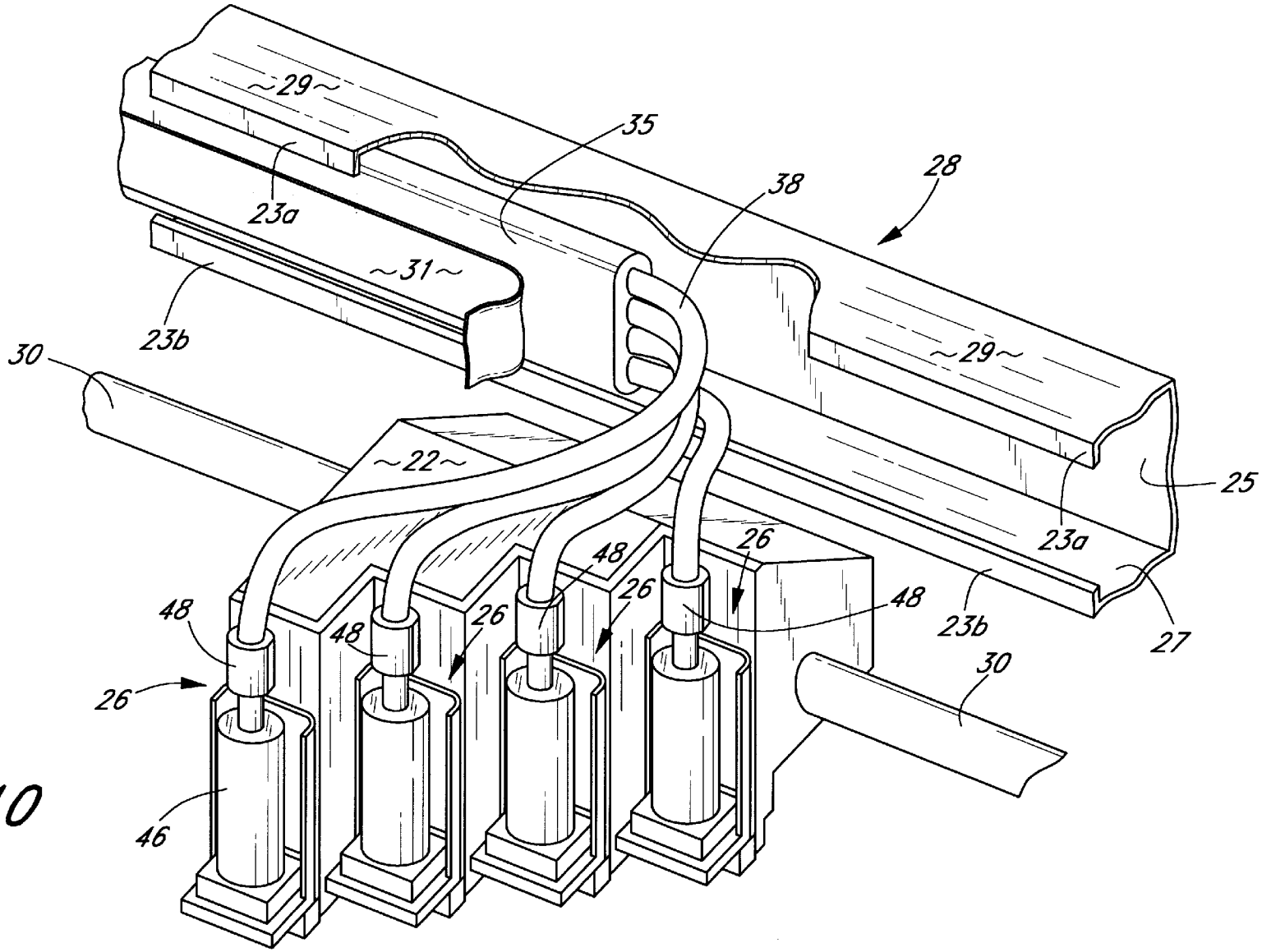
FIG. 10 is a detailed cut away view of the print carriage and the cable carrier track of the ink jet printer.

As illustrated in FIG. 10, mounted behind and slightly above the print carriage 22 such that it is parallel with the guide rod 30 is a cable carrier track 28. The cable carrier track 28 is preferably a U-shaped bracket having two short sides 27, 29 and a long side 25. The cable carrier track 28 constrains the motion of a ribbon cable 31 which, as known to those in the art, transfers electronic signals to the print carriage 22 and an ink supply carrier assembly 33 to deliver ink to the print carriage 22. Preferably, the long side 25 of the bracket is mounted to the inside of the rear wall 16 of the housing 12. The two short sides 27, 29 of the carrier track 28 are used to contain the ink supply carrier assembly 33 and the ribbon cable 31 as the print carriage 22 moves back and forth. A short lip 23*a*, 23*b* is located along the edge of each of the short sides 27, 29. These lips further constrain the ink supply carrier assembly 33 and the ribbon cable 31 within the carrier track 28. The space in between the two lips 23*a*, 23*b* enable the ink supply carrier 33 and ribbon cable 31 to exit the carrier track 28 and connect to the print carriage 22 as the carriage 22 is moving back and forth along the guide rod 30.

Figure 2:
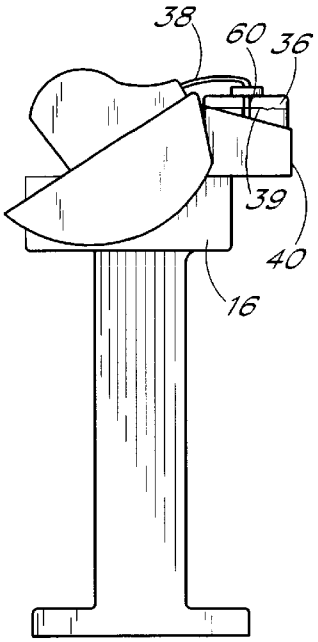
FIG. 2 is an end view of an ink jet printer comprising the ink supply system of the present invention.

In accordance with the present invention, each of the novel print heads 26, as shown in FIGS. 1–2, is connected to a remotely located large refillable container or reservoir 36 via tubing 38. The tubing 38 is preferably of a length which is sufficient to maintain the connection of the ink reservoir 36 to the print heads 26 while the print carriage 22 upon which the print head 26 is mounted moves along the length of the platen 18. Therefore, the length of the tubing 38 will vary depending upon the size of the plotter and the length of the carriage 22. In a specific embodiment, the tubing 38 is has an outer diameter of 0.125 inches and an inner diameter of 0.063 inches. In specific embodiment of a D size plotter, the tubing length is 63 inches; in an E size plotter, the tubing length is 75 inches; and in a F size plotter, the tubing length is 87 inches. The tubing 38 holds approximately 4 ml of ink along its length. In addition, the tubing 38 of the preferred embodiment is a bundle of four lengths of tubing which are fused together along their length which is commonly referred to as quad tubing. The tubing 38 has a plurality of longitudinally joined flexible hollow ink tubes. The fused length of tubing is separated into four individual strands of tubing at each end for connection to each the ink jet cartridges at one end and to each of the reservoirs at the other end. One example of a four bundle polyurethane tubing is available as part number 4D-026-10 from Freelin-Wade Corp. located in McMinnville, Oreg.

Figure 11:
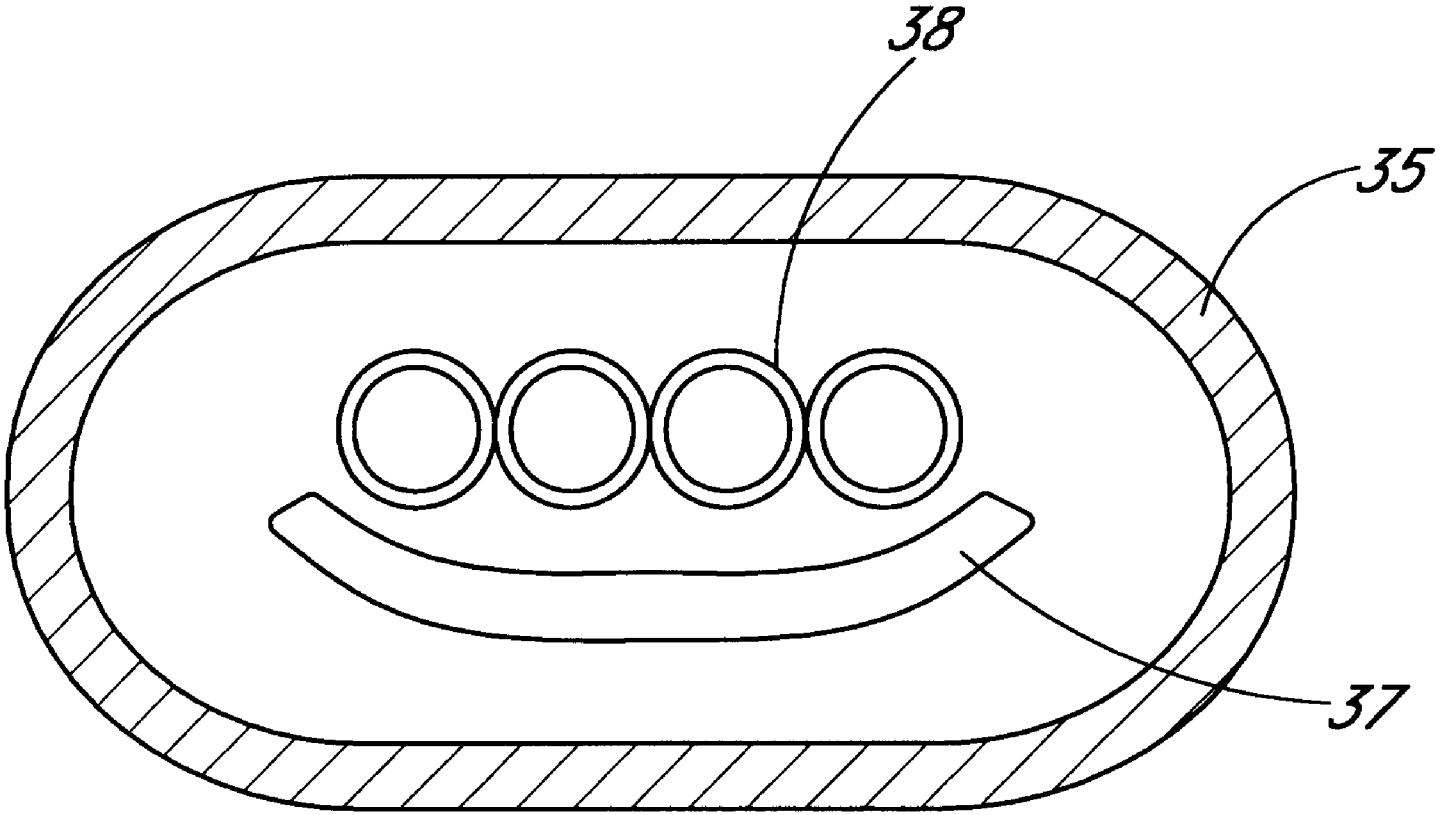
FIG. 11 is an end view of the ink supply carrier assembly.

As the carriage 22 is moved back and forth across the guide rod 30, the tubing 38 is carried along behind it and the flow of ink to the cartridge 26 is not be interrupted during the movement of the tubing 38. Further, the tubing 38 is moved in a smooth fashion to prevent unwanted vibrations in the tubing 38 to occur. Such vibrations would translate into vibrations in the ink 39 and in the carriage 22 which would degrade the printing quality. In the preferred embodiment, the quad tubing 38 is a part of an ink supply carrier assembly, as illustrated in FIG. 11, which assists the smooth movement of the tubing within the printer. The ink supply carrier assembly further comprises a curved rigid thin stainless steel blade 37 and uncoated fiberglass sleeving 35. The rigid thin stainless steel blade 37 may also be reffered to as a resilient concavo-convex shaped spring. In the preferred embodiment, the quad tubing 38 is laid against the concave side of a curved thin rigid steel blade 37. In the specific embodiments constructed to date, the blade 37 has been formed from a portion of a standard Armstrong tape measure. The tubing 38 and the blade 37 are preferably jacketed by the piece of uncoated fiber glass sleeving 35. The fiber glass sleeving 35 is available from Alpha Wire Corp. as part number PIF-240-½. The fiber glass sleeving 35 and the tape measure are mounted at one end to the carriage 22 and at another end to the printer housing 12. The tubing 38 is free to move within the sleeving 35 and each portion of the quad tubing 38 is mounted at one end to an ink reservoir 36 and at the other end to an ink cartridge 26.

The ink reservoir 36 is shown generally rectangular in shape. As will be recognized by those of skill in the art, the ink reservoir 36 may also take on a variety of other shapes, such as cylindrical, square, sloped, etc., depending upon the constraints of the mounting location of the reservoirs 36 on the printer 10. By way of example, in accordance with a specific embodiment of the invention, the ink reservoir 36 is a rectangular shaped reservoir having dimensions of 1.25 inches by 5.5 inches by 5 inches and holds 500 ml of ink 39. As will be recognized by those of skill in the art, the size of the ink reservoir 36 may be varied, that is, if the printer is designed for large volume printing, the reservoir size may be increased. If the printer 10 is designed for smaller print volumes, the reservoir size may be decreased. In addition, the ink reservoir 36 need not be filled to its maximum volume if the users print needs are smaller than the volume of ink held in the reservoir 36.

Figures 3, 4, 5, 6, 7, 8:
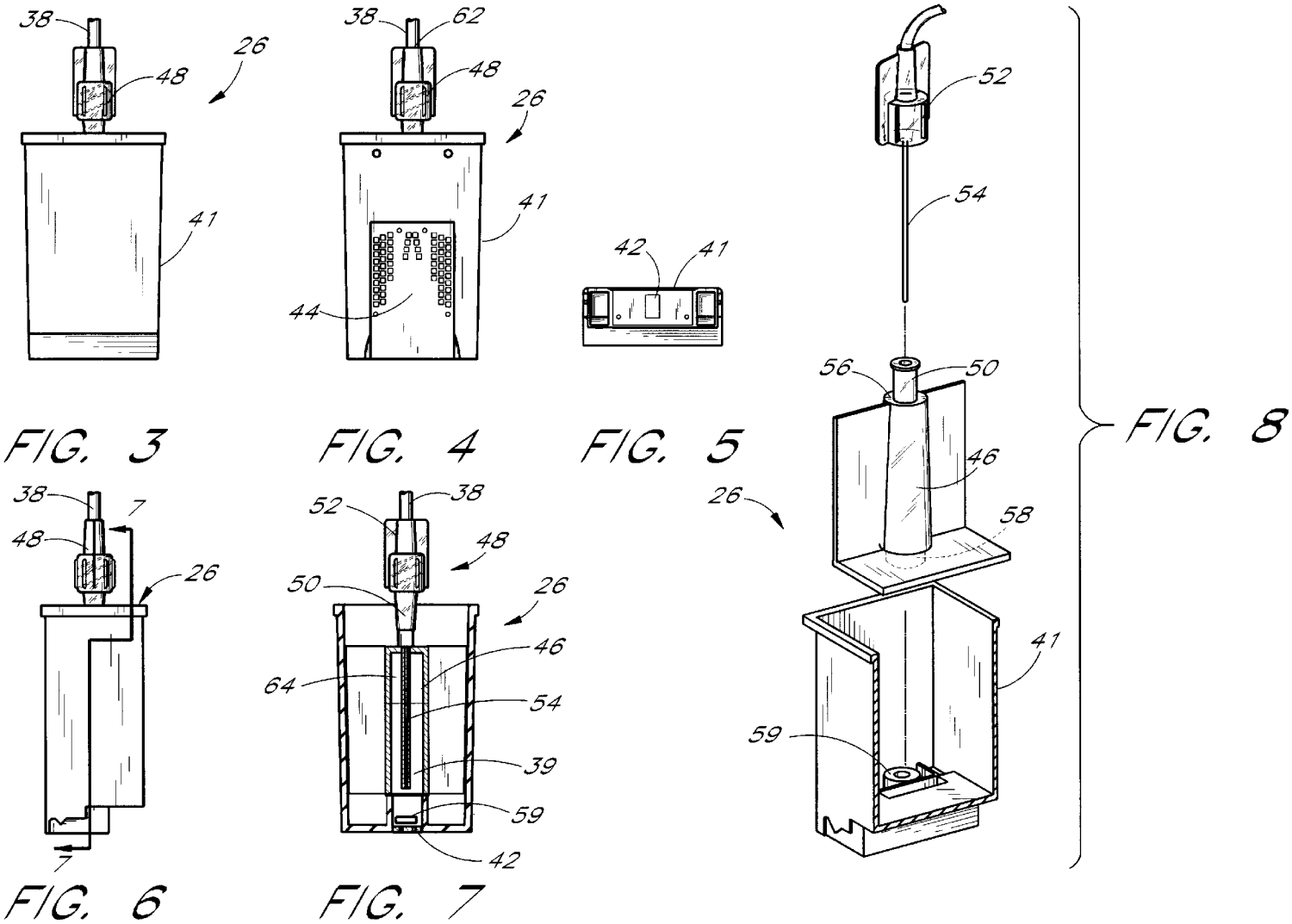
FIG. 3 is a detailed front view of an ink jet cartridge of the ink supply system of the present invention.
FIG. 4 is a rear view of the ink jet cartridge depicted in FIG. 3.
FIG. 5 is a bottom view of the ink jet cartridge depicted in FIG. 3.
FIG. 6 is a side view of the ink jet cartridge depicted in FIG. 3.
FIG. 7 is a cross sectional view of the ink jet cartridge along the line 7—7 as in FIG. 3.
FIG. 8 is an exploded cutaway view of the ink jet cartridge depicted in FIG. 3.

As illustrated in FIG. 2, each of the ink reservoirs 36 is preferably positioned in a reservoir stand 40 which is attached to the rear side 16 of the housing 12. Ink 39 in the ink reservoir 36 is delivered to its corresponding print head 26 on the printer carriage 22, utilizing a negative pressure difference developed between the print head 26 and the reservoir 36 by a priming process described in more detail below. In order to ensure that the negative pressure in the print head 26 relative to the pressure in the ink reservoir 36 is maintained, the ink reservoir stand 40 is mounted to the housing 12 such that the ink level in the reservoir 36 is maintained at a height differential of two to seven inches below the ink level in the print head 26 causing the ink in the ink jet cartridge 26 to be maintained at a negative pressure of between 2 in $H_2O$ and 7 in $H_2O$. If the ink in the ink jet cartridge 26 is maintained at less than 2 in $H_2O$ negative pressure ink will leak from the cartridge 26. If the ink in the ink jet cartridge is maintained at more than 7 in $H_2O$ negative pressure insufficient ink will be delivered to the jet plate (FIG. 5) during high firing rate operations causing "ink starvation" to occur at the jet plate.

Therefore, the ink reservoir stand 40 is preferably mounted to the housing 12 so that when the ink reservoirs 36 are full, the ink level of the full ink reservoir 36 is two inches below the ink level in the print head 26. As the ink 39 in the ink reservoir 36 is depleted, the height differential between the ink 39 in the ink reservoir 36 and the print head 26 will increase and, in the preferred embodiment, will not fall below seven inches when the ink reservoir 36 approaches empty.

As illustrated in FIGS. 3–8, the print head 26, also referred to as ink jet cartridge, is much smaller than the typical ink jet cartridges of the prior art. In the embodiment shown, the ink jet cartridge is rectangular in shape having dimensions of approximately, 0.5 inches wide by 1.25 inched long by 1.75 inches high. However, those of skill in the art will recognize that ink jet cartridges 26 constructed in accordance with the invention may take on a variety of shapes depending upon the configuration of the printer carriage 22 and the profile of the printer housing 12 within which the carriage 22 is contained.

The ink jet cartridge 26 includes a cartridge housing 41, a jet plate 42, an electrical connector assembly 44, a hollow ink channel 46, a connecting tube 54 mounted within the hollow ink channel 46, and a quick disconnect fitting 48 having mating first and second portions, 50 and 52, respectively. Preferably, the electrical connector assembly 44 is positioned on the cartridge housing 41 to align with a mating electrical connector assembly (not shown) on the print head holder 24 as is conventional for ink jet printers. The connector assembly 44 transfers electrical control signals from the main control electronics in the printer housing 12 to the jet plate 42 to control the printing operation in a manner well known in the art.

The jet plate 42 includes a plurality of ink jet nozzles which may be conventional in design. Jet plate 42 is mounted to a bottom surface of the cartridge housing 41 and in alignment with the platen 18 such that the ink 39 is ejected from the jet plate 42 for deposition onto paper or other print media which is positioned on the platen 18 below the ink jet cartridge 26.

In one embodiment, the connecting tube 54 comprises a stainless steel tube. In an alternate embodiment, the connecting tube 54 comprises a polyurethane tube. In the preferred embodiment, the connecting tube 54 has a 0.062 inch inner diameter and a 0.125 inch outer diameter.

The quick disconnect fitting 48 is mounted atop the cartridge housing 41 and is utilized to connect the ink jet cartridge 26 to the tubing 38 to enable easy replacement of the cartridge 26. As noted, the quick disconnect 48 includes the first portion or fitting 50, which is integral to the cartridge 26, as well as the second portion or coupling 52, bonded to the tubing 38. Preferably, the quick disconnect fitting 48 is a conventional luer-lock fitting wherein the first and second portions are mating female and male ends, 50 and 52, respectively, such as available as Part No. 71350 and Part No. 65105, respectively, from Qozina Company in Edgewood, N.Y. The quick disconnect fitting 48 advantageously enables the easy removal of the ink jet cartridge from the tubing 38. Thus, when the print quality of the jet plate 42 begins to degrade, the ink jet cartridge 26 can be easily removed and replaced with a new cartridge having a new jet plate 42. Preferably, the connection of the female end 50 to the male end 52 of the quick disconnect device 48 includes the development of a hermetic seal between them when connected.

A second end 62 of the tubing 38 is connected to a first end of the male portion 52 of the quick disconnect fitting 48. An opposite end of the male portion 52 of the quick disconnect fitting 48 is connected to a first end of the connecting tube 54 and a hermetic seal is formed at this connection. The tube 54 is bonded to the male portion 52 of the quick disconnect fitting 48 by conventional bonding methods known to those of skill in the art. Preferably, the connecting tube 54 is attached to the quick disconnect fitting 48 by an adhesive bond.

The female end 50 of the quick disconnect fitting 48 is connected to an upper end 56 of the ink channel 46 and a hermetic seal is formed at this connection. The female portion 50 of the quick disconnect fitting 48 is connected to the ink channel 46 by conventional bonding methods known to those of skill in the art. Preferably, the female portion 50 of the quick disconnect fitting 48 is attached to the upper end 56 of the ink channel 46 by an adhesive.

In an alternate embodiment, the female portion 50 of the quick disconnect fitting 48 is formed as an integral assembly with the upper end 56 of the ink channel 46. In this embodiment, the integral molded connection of the female portion 50 of the quick disconnect fitting 48 to the upper end 56 of the ink channel 46 alleviates the need for a hermetic seal to be formed at the junction of the two pieces. In another embodiment, the female portion 50 of the quick disconnect fitting 48 is formed as an integral assembly with the housing 41.

In an alternate embodiment, a first end of the connecting tube 54 is connected to the female portion 50 of the quick disconnect fitting instead of being connected to the male portion 52 of the quick disconnect fitting 48. In this embodiment, a first end of the female portion 50 of the quick disconnect fitting 48 is connected to the male end 52 of the quick disconnect fitting 48 and a second end of the female portion 50 of the quick disconnect fitting 48 is connected to the connecting tube 54. Preferably, the second end of the female portion 50 of the quick disconnect fitting 48 is bonded to the connecting tube 54 by conventional bonding methods known to those of skill in the art. Preferably, the connecting tube 54 is attached to the quick disconnect fitting 48 by an adhesive bond.

The ink channel 46 is generally shown as a cylindrical shaped tube. However, as known to those of skill in the art the ink channel can take on any number of shapes, such as rectangular, square, a flared cylinder, etc., which are capable of routing ink 39 to the jet plate 42. In the preferred embodiment, the ink channel 46 has a 3 ml volume and contains approximately 1.5 ml of ink 39 and an air pocket 64 which contains 1.5 ml of air. Other ratios of air 64 to ink 39 are contemplated, however, a 1:1 ratio is presently preferred. In an alternate embodiment, the ink channel is rectangular in shape having inner dimensions of 0.375 inch by 0.375 inch and the outer dimensions of the rectangular channel are 0.5 inch by 0.5 inch and the rectangular channel is preferably 1.75 inches tall. Preferably, the ink channel 46 has three guiding wings extending from the ink channel 46 to aid in positioning the ink channel 46 in the housing 41. Two of the wings extend laterally from the sides of the ink channel 46 and the third wing extends orthogonal from a bottom end 58 of the ink channel 46. The laterally extending wings contact the side walls of the housing 41 and centers the ink channel 46 in the housing 41. The bottom wing contacts a surface proximal to a feeder assembly 59 for positioning the ink channel 46 and providing structural integrity for the ink channel 46.

The volume of ink 39 maintained in the ink channel 46 is not large enough to be considered a reservoir of ink 39, as this term is know in the industry. For example, the volume of ink that is contained in the tubing 38 is greater than the volume of ink 39 in the ink channel 46. By way of example, in a specific embodiment of the invention, the volume of ink 39 that is maintained in the ink channel 46, i.e., 2 ml of ink 39, is half the amount of ink that is contained in the tubing 38, i.e., 4 ml. Thus, only the external ink reservoir 36 contains enough ink 39 to be considered an ink storage container. In the preferred embodiment of the invention, the tubing 38 and the ink channel 46 provide a path for delivery of ink directly to the jet plate 42 and do not contain a "reservoir" or "supply" of ink as these terms are conventionally used in the art.

The ink path of the ink system is formed by inserting a first end 60 of the tubing 38 into the ink 39 contained in the ink reservoir 36. Preferably, the first end 60 of the tubing 38 is inserted into the bottom of the ink reservoir 36. The second end 62 of the tubing 38 is connected to a first end of the male end 52 of the quick disconnect fitting 48. The connecting tube 54 attached to the opposite end of the male end 52 of the quick disconnect fitting is insertable into the female portion 50 of the quick disconnect fitting 48 and a hermetic connection between the female 50 and male 52 ends of the quick disconnect fitting 48 are made. The tube 54 extends into the ink channel 46 such that an opposite end of the connecting tube 54 is proximal to a lower end 58 of the ink channel 46. The opposite end of the tube 54 extends into the ink 39 which is maintained within the ink channel 46. In the preferred embodiment, the opposite end of the connecting tube 54 terminates at a height of approximately 0.3 inches above the lower end 58 of the ink channel 46. The lower end 58 of the ink channel 46 is connected to a feeder assembly 59 for delivering ink 39 to the jet plate 42. The feeder assembly 59 preferably comprises a filter plate and filter chimney , as known to those of skill in the art, for delivering ink 39 to the resistor above each of the openings on the jet plate 42.

The ink channel 46 contains only a minute amount of ink 39 and the remainder of the channel 46 is filled with air 64. The air pocket 64 and the small quantity of ink 39 act as a "buffer" between the ink 39 supplied by the external ink reservoir 36 and the ink 39 which is drawn into the jet plate 42 to absorb pressure shockwaves in the ink 39 that are caused by moving the ink 39 through the ink supply system. The action of drawing the ink 39 from the tubing 38 into the ink channel 46 results in small pressure shockwaves that travel through the ink 39. The shockwaves can reflect against the walls of the tubing 38 and can build up to a significant level. As the pressure shockwaves approach the jet plate 42, the force of the shockwaves can actually draw the ink droplet that is to be expelled back into the jet plate 42 when the force of the shockwaves is greater than and opposite to the force of gravity on the ink drop. If the ink was supplied directly from the ink reservoir 36 through the tubing 38 and directly to the jet plate 42, these shockwaves would cause noticeable effects on the print quality. The small volume of ink 39 in the ink channel 46 helps absorb the shockwaves in the ink 39 and transfers the shockwaves to the air pocket 64 which is formed in the ink channel 46. The ink 39 in the channel acts as a buffer to transfer the shockwaves in the noncompressible ink 39 caused by moving the ink 39 through the ink system to the compressible air pocket 64, thus preventing the shockwaves from effecting the print quality.

Advantageously, the ink channel 46 of the present invention contains both a small quantity of ink 39 and a pocket of air 64 at a negative pressure relative to atmospheric pressure. As is known to those of skill in the art, the negative air pressure provides tension on the ink 39, which prevents the effects of gravity from draining all of the ink 39 out of the ink jet cartridge 26. When ink 39 in the ink channel 46 is depleted by the ejection of ink 39 through the jet plate 42, the volume of ink 39 in the channel decreases by a minute amount and the volume of the air in the ink channel 46 increases. Because the air pocket 64 above the ink 39 cannot access air, the pressure in the air pocket 64 decreases slightly and draws ink 39 from the external ink reservoir 36 in order to return the internal air pressure to the equilibrium level. Thus, the small volume of ink 39 in the ink channel 46 is maintained at essentially the same level throughout the operation of the ink jet cartridge 26.

The ink system of the present invention is a departure from ink systems of the prior art in which ink jet cartridges contain a reservoir of ink 39 which depletes over the lifetime of the ink jet cartridge. Some of the prior art systems enable the reservoir in the ink jet cartridge to be refilled, however, the design of those prior art inking systems is intended to deplete the reservoir on the ink jet cartridge and then to refill it from an external supply.

Advantageously, the ink system of the present invention does not have a reservoir of ink 39 on the ink jet cartridge 26. In fact, if the ink jet cartridge 26 is disconnected from the external ink reservoir 36, the ink jet cartridge 26 is not capable of printing for several reasons. First, the quantity of ink 39 maintained in the ink channel 46 is insufficient to enable printing for any realistic period of time. Secondly, when the ink jet cartridge 26 is disconnected from the external reservoir 36, the negative pressure air pocket 64 in the ink channel 46 is lost because the ink channel 46 becomes open to the atmosphere . Without the negative pressure differential in the ink channel 46, the ink 39 contained in the ink channel 46 will leak out through the jet plate 42 due to gravitational effects on the ink 39 and is not capable of providing controlled printing.

Advantageously, the ink supply system of the present invention is designed such that the ink reservoir 36 and the tubing 38 are permanently mounted in the ink jet printer 10. The ink reservoir 36 is mounted within the ink reservoir stand 40 on the rear end of the housing 12. The tubing 38 which extends from the ink reservoir 36 is routed into the housing 12 and is positioned within the housing 12, such that the tubing 38 does not interfere with the operation of the print carriage 22. The tubing 38 is fed into the print carriage 22 along individual channels which direct the tubing 38 proximal to its respective ink jet cartridge holder 24. When the ink jet cartridge 26 is placed in the ink jet cartridge holder 24, the female end 50 of the quick disconnect fitting 48 protrudes from a top end of the cartridge 26. The second end 62 of the tubing 38 having the male end 52 of the quick disconnect fitting 48 and the connecting tube 54 attached thereto, is positioned over the ink jet cartridge 26 such that the tube 54 is placed within the female end 50 of the quick disconnect fitting 48 as it extends from the upper end 56 of the ink jet cartridge 26. Once the connecting tube 54 is completely inserted in the ink channel 46, the male end 52 of the quick disconnect fitting 48 mates with the female end 50 on the cartridge 26 and the connection of the tubing 38 is made with the ink channel 46. Advantageously, the ink jet cartridge 26 can be easily disconnected from the tubing 38 via the quick disconnect fitting 48 and replaced with a new ink jet cartridge 26 having a new jet plate assembly 42. Thus, when the level of printing from the ink jet plate 42 has degraded to a level which is no longer satisfactory, the ink jet cartridge 26 can be quickly removed and replaced with a new cartridge 26. Each time the ink jet cartridge 26 is replaced, the system is primed (i) to force the ink 39 from the reservoir 36 into the ink channel 46, (ii) to remove the excess air from the ink system and (iii) to create the desired negative pressure differential in the ink jet cartridge 26.

As discussed briefly above, ink 39 from the ink reservoir 36 is advantageously delivered to the ink jet cartridge 26 without requiring any active components such as a pumping device. Preferably the ink from the ink reservoir 36 is drawn through the tubing 38 by the negative pressure difference between the ink jet cartridge 26 and the ink reservoir 36 which acts as a siphon. In order to create the siphon effect, a negative pressure must be developed in the ink jet cartridge 26 relative to the ink reservoir 36 which remains at atmospheric pressure. The generation of a negative pressure within the ink jet cartridge 26 is referred to as priming the ink jet cartridge 26 and can be accomplished by a variety of procedures known to those of skill in the art.

Figure 9:
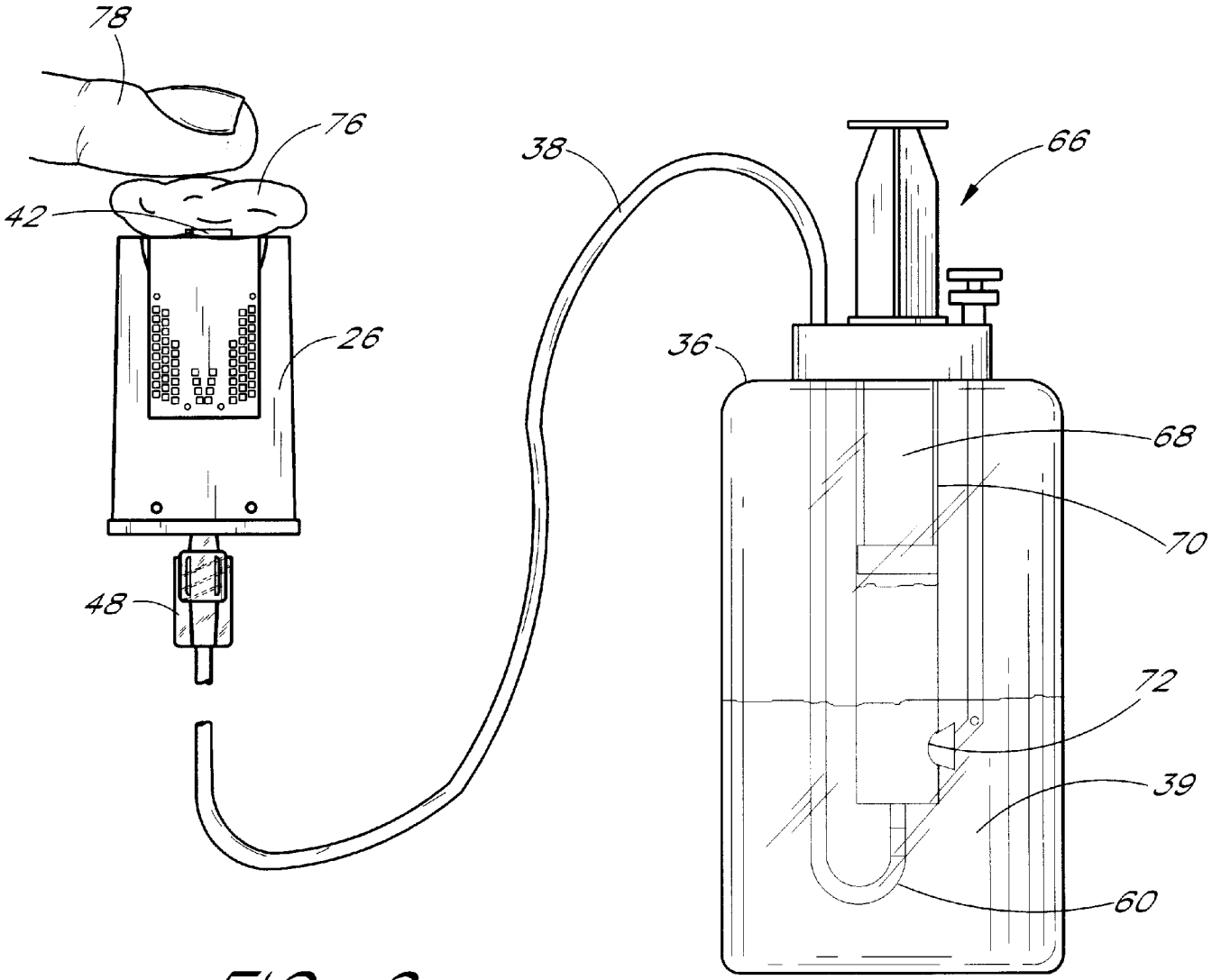
FIG. 9 is a view of the ink jet printer and the ink supply system of the present invention illustrating the procedure of priming of the ink supply system.

FIG. 9 illustrates one procedure for priming the ink system. In order to create the negative air pressure pocket 64 in the ink jet cartridge 26, as described above, the ink reservoir 36 is positioned such that the ink level in the ink jet reservoir 26 remains at a height which is lower than the height of the ink level in the ink jet cartridge 26. In order to prime the ink cartridge 26 to create the desired siphon, all of the air in the tubing 38 and in the ink channel 46 must be removed to create the desired suction between the ink reservoir 36 and the ink cartridge 26.

Preferably, the first end 60 of the tubing 38 which is normally positioned near the bottom of the ink reservoir 36 is attached to a conventional piston assembly 66, having a piston 68 contained within a piston housing 70. Preferably, the piston assembly 66 has a hole 72 in the piston housing 70 below the level of the piston 68 in its resting position. After the piston assembly 66 is connected to the tubing 38, the end of the piston assembly 66 connected to the tubing 38 and the tubing 38 are submerged within the ink 39 in the ink reservoir 36 such that the hole 72 in the piston housing 70 is submerged under the ink 39 in the ink reservoir 36 enabling the piston housing 70 below the piston 68 to fill with ink 39. Once the piston housing 70 has filled with ink 39 up to the level of the piston 68, the hole 72 in the housing 70 is plugged by depressing a push button 78. The push button 78 is connected to a first arm 80 which is connected at a pivot point 82 to a second arm 82. When the push button 78 is depressed, the second arm 82 actuates and a stopper 84 is inserted into the hole 72 to close the hole 72.

The ink jet cartridge 26 is removed from the print head holder 24 on the printer 22 and is turned upside down such that the jet plate assembly 42 is being held upwards. Preferably the jet plate assembly 42 is covered with a wad of cotton 76 or other absorbent material which is held against the jet plate assembly 42 by the user's finger 78. The piston 68 of the piston assembly 66 is pressed within the housing 70 thus (i) forcing ink through the tubing 38 into the ink channel 46 and (ii) forcing ink 39 out the jet plate 42. As the ink 39 is pushed through the tubing 38 and ink channel 46, it forces out any air that is contained in the ink system. The user continues to depress the piston 68 until all of the air is forced out of the ink system through the jet plate assembly 42 and only ink is being expelled from the jet plate 42. Preferably, the piston 68 stays above the level of the hole 72 in the piston housing 70 such that the piston 68 does not interfere with the stopper 84 in the hole 72. Once the excess air is removed from the tubing 38, the cotton 76 is removed from the jet plate 42 with all of the expelled ink 39 trapped therein and is thrown away. The ink jet cartridge 26 is inverted back into its normal position and placed in the print head holder 24 on the printer carriage 22. The inversion of the ink jet cartridge 26 creates the air pocket 64 in the ink channel 46. The push button 78 is retracted, the second arm 82 retracts and the stopper 84 is withdrawn from the hole 72 to open the hole 72 and the first end of the tubing 38 is open to the ink through the piston assembly 66 via the hole 72.

After priming, if the air pocket 64 is not large enough, it may be necessary to draw ink 39 out of the ink channel 46. In order to draw ink out of the ink channel 46, the ink jet cartridge 26 remains mounted to the printer carriage (not shown) in its normal operating position while the push button 78 is depressed thus closing the hole 72 in the piston housing 70 with the stopper 84. As the piston 68 is retracted, ink 39 is drawn from the ink channel 46 back into the piston housing 70. Once the ink level in the ink channel 46 is set to the desired level, the push button 78 is retracted withdrawing the stopper 84 from the hole 72 in the housing 70 and the first end of the tubing 38 is open to the ink through the piston assembly 66 via the hole 72. At this point, the ink system is primed for use.

In one embodiment, as the first end 60 of the tubing 38 is kept submerged within the ink 39 of the ink reservoir 36, the piston assembly 66 is removed and the first end 60 of the tubing 38 is directly open to the ink 39 in the ink reservoir 36.

Referring back to FIGS. 1–8, since the ink reservoir 36 is open to atmospheric pressure, the user can refill the ink reservoir 36 through the opening to atmosphere or through a larger refill opening in the ink reservoir 36 (i) during normal printing operations without halting the current print job, (ii) without disturbing the siphon effect in the ink system and (iii) without requiring repriming of the ink supply system.

Advantageously, because a small volume of ink 39 is maintained in the ink channel 46, i.e. only a sufficient amount of ink 39 to buffer the ink 39 supplied from the external ink reservoir 36 to the jet plate 42, the profile of the ink jet cartridge 26 can be reduced thus allowing a slim and narrow cartridge 26 to replace the larger ink cartridges which contain a large ink reservoir thereon. By reducing the size of the ink jet cartridge 26, additional cartridges 26 can be added to the print carriage 22 thus enabling additional ink colors to be added without increasing the size of the carriage 22. Further, the reduced size of the ink jet cartridge 26 (i) lowers shipping costs of the cartridges 26, (ii) reduces the storage area required for the ink jet cartridges 26 and (iii) reduces the overall material usage to form the cartridges 26. Therefore, the ink jet cartridges 26 will be able to be offered at a lower cost to the users. In addition, the overall profile of the printer 10 can be reduced, since the printer 10 need contain only these smaller cartridges 26.

Further, by reducing the volume of ink 39 stored in the ink jet cartridges 26, the overall load on the print carriage 22 is reduced. The reduced load on the print carriage 22 reduces the motor requirements to propel the print carriage 22. Since the relatively low volume of ink 39 in the ink jet cartridges 26 remains constant, the load on the printer cartridge 22 remains the same and the motor need only be designed to handle the known constant ink volume of the cartridges 26. This is advantageous over the prior art systems that had motors which were designed to operate under loads varying from four full ink jet cartridge reservoirs to four almost empty ink jet cartridge reservoirs and all variations in between, thus the motor had to be designed to over compensate for the four full cartridge condition which was a condition that only occurred for a short amount of time. By reducing the motor loading, the cost of manufacturing the ink jet printer 10 is reduced.

In addition, the ink jet cartridges 26 are mounted only on one side of the printer carriage 22 and create loading problems about the guide rod 30 which have to be compensated for. By maintaining the volume of ink 39 contained in the ink cartridge 26 at a constant level and by reducing the volume of ink in the ink cartridges 26 to a very nominal volume, the torque of the printer carriage 22 about the guide rod 30 due to the weight of the ink 39 on one side of the carriage 22 is substantially reduced. Further, since the ink volume is maintained at a constant level, the counter balancing effects required to counteract the weight of the ink 39 need only be adapted to the known weight of the small volume of ink 39 maintained in the ink jet cartridges 26. Thus, the manufacturing the print carriage 22 is simplified.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. An ink supply system for a multi-color ink jet printer having a moveable print carriage, said ink supply system comprising:

a plurality of replaceable ink jet cartridges, carried on said moveable print carriage, each of said ink jet cartridges comprising an outer housing defining an overall interior volume, a jet plate having a plurality of orifices for selective ink ejection onto a media substrate, an inner housing defining an ink channel having upper and lower ends extending from a top portion of said outer housing to a bottom portion of said outer housing, said ink channel defining an interior volume thereof which is substantially smaller than said overall interior volume defined by said outer housing, wherein said ink channel contains ink and an unvented air pocket, wherein said upper end of said ink channel comprises an integral quick disconnect fitting attached to and extending approximately vertically upward from said outer housing, wherein an end of said integral quick disconnect fitting is adjacent to said unvented air pocket, wherein each of said ink jet cartridges includes no ink outlet from said interior volume other than said orifices, and wherein said jet plate is situated substantially beneath said lower end of said ink channel;

a plurality of large volume ink containers mounted to said multi-color ink jet printer, said large volume ink containers being refillable;

a plurality of tubes, each of said plurality of tubes having a first end and a second end, said first end connected to one of said plurality of ink containers and said second end comprising a quick disconnect coupling mating to said integral quick disconnect fitting of one of said ink jet cartridges to connect to said one of said plurality of ink jet cartridges therewith, each of said plurality of tubes thereby comprising an ink inlet to said interior volume of one of said ink jet cartridges to transport ink from one of said ink containers to one of said jet plates.

2. The ink supply system of claim 1 wherein said unvented air pocket is at a pressure less than atmospheric.

3. The ink supply system of claim 2 wherein pressure variations in said air pockets during printing maintain a level of ink in each of said ink jet cartridges at a substantially constant level.

4. The ink supply system of claim 2 wherein said unvented air pockets buffer print induced vibrations in said ink.

5. An ink supply system for a multi-color ink jet printer which provides a large volume container of ink for each of a plurality of jet plates carried on a movable print carriage without adding excess weight to the movable print carriage and substantially eliminating waste associated with disposing of ink containers, said ink supply system comprising:

a plurality of replaceable ink jet cartridges carried on said movable print carriage, each said cartridge comprising:

a housing, having a top end and a bottom end;

a jet plate connected to said bottom end of said housing;

an ink channel within said housing containing an unvented air pocket and having a first and a second end, wherein said first end of said ink channel is operatively connected to said jet plate for supplying ink to said jet plate;

an ink input connector integral to said cartridge and extending vertically upward from said top end of said housing and coupled to said second end of said ink channel for delivering ink to said ink channel;

a plurality of large volume ink containers mounted to said multi-color ink jet printer; and, a tube system connecting said large volume ink containers to said plurality of replaceable ink jet cartridges, wherein said tube system comprises a plurality of longitudinally joined flexible hollow ink tubes, a resilient concavo-convex shaped spring, and a generally flexible housing retaining said ink tubes juxtaposed a concave portion of said spring while allowing said ink tubes to slide with respect to said spring and said housing.

6. A replaceable stand alone ink jet cartridge for use in an ink jet printer having a print carriage and an ink container separate from said cartridge, said ink jet cartridge comprising:

an outer housing mountable to the print carriage of the ink jet printer, said outer housing defining an overall interior volume;

a jet plate connected to said housing, said jet plate comprising the only ink outlet from said ink jet cartridge;

an ink channel contained within said outer housing, said ink channel having a first end and a second end and defining an interior volume thereof which is substantially smaller than said overall interior volume defined by said outer housing, wherein said first end of said ink channel is proximate to said jet plate and directs ink to said jet plate, and wherein said second end of said ink channel comprises an unvented air pocket and an ink input connector which extends from said outer housing.

* * * * *